US006607783B1

(12) United States Patent
Vander Heiden et al.

(10) Patent No.: US 6,607,783 B1
(45) Date of Patent: Aug. 19, 2003

(54) METHOD OF APPLYING A FOAM COMPOSITION ONTO A TISSUE AND TISSUE PRODUCTS FORMED THEREFROM

(75) Inventors: Daniel J. Vander Heiden, Menasha, WI (US); Wen Schroeder, Appleton, WI (US); Alexander F. Gunn, North Augusta, SC (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/645,649

(22) Filed: Aug. 24, 2000

(51) Int. Cl.[7] ..... B05D 5/00
(52) U.S. Cl. ..... 427/210; 427/209; 427/288; 427/243; 427/356; 427/358
(58) Field of Search ..... 427/209, 210, 427/356, 358, 243, 288

(56) References Cited

U.S. PATENT DOCUMENTS

| | | | |
|---|---|---|---|
| 3,722,469 | A | 3/1973 | Bartley et al. |
| 3,865,078 | A | 2/1975 | De Howitt et al. |
| 3,905,329 | A | 9/1975 | Cone et al. |
| 3,930,465 | A | 1/1976 | Schuierer |
| 4,005,028 | A | 1/1977 | Heckert et al. |
| 4,005,030 | A | 1/1977 | Heckert et al. |
| 4,016,831 | A | 4/1977 | James et al. |
| 4,023,526 | A | 5/1977 | Ashmus et al. |
| 4,061,001 | A | 12/1977 | von der Eltz et al. |
| 4,081,318 | A | 3/1978 | Wietsma |
| 4,089,296 | A | 5/1978 | Barchi |
| 4,099,913 | A | 7/1978 | Walter et al. |
| 4,118,526 | A | 10/1978 | Gregorian et al. |
| 4,158,076 | A | 6/1979 | Wallsten |
| 4,159,355 | A | 6/1979 | Kaufman |
| 4,184,914 | A | 1/1980 | Jenkins |
| 4,193,762 | A | 3/1980 | Namboodri |
| 4,198,316 | A | 4/1980 | Nahta |
| 4,230,746 | A | 10/1980 | Nahta |
| 4,237,818 | A | 12/1980 | Clifford et al. |
| 4,263,344 | A | 4/1981 | Radvan et al. |
| 4,276,339 | A | 6/1981 | Stoveken |
| 4,279,964 | A | 7/1981 | Heller |
| 4,288,475 | A | 9/1981 | Meeker |
| 4,297,860 | A | 11/1981 | Pacifici et al. |

(List continued on next page.)

FOREIGN PATENT DOCUMENTS

| | | |
|---|---|---|
| EP | 0098362 B1 | 1/1984 |
| EP | 0195458 A1 | 9/1986 |
| EP | 0196575 | 4/1989 |
| EP | 0336439 A2 | 10/1989 |
| EP | 1149947 | 10/2001 |
| WO | WO 9840207 | 9/1998 |
| WO | WO 9913158 | 3/1999 |
| WO | WO 9919081 | 4/1999 |
| WO | WO 0015907 | 3/2000 |

OTHER PUBLICATIONS

Recent Developements in Foam Application Systems (no date).

International Search Report, May 27, 2002.

*Primary Examiner*—Katherine A. Bareford
(74) *Attorney, Agent, or Firm*—Dority & Manning, P.A.

(57) ABSTRACT

A method for foaming a liquid-based composition, such as a softening composition, onto a tissue is provided. The foam composition can be formed in a foam generator by combining the liquid-based composition and a gas, such as air. The foam composition has a blow ratio, i.e, ratio of air volume to liquid volume, greater than about 3:1. Moreover, the foam composition is also generally stable such that it has a half-life greater than about 3 minutes. In one embodiment, a tissue product having elevated regions and non-elevated regions can be foamed with a foam composition such that the elevated regions are applied with a greater amount of the foam composition than the non-elevated regions.

20 Claims, 3 Drawing Sheets

U.S. PATENT DOCUMENTS 4,305,169 A 12/1981 Vidalis
4,343,835 A 8/1982 Jones et al.
4,348,251 A 9/1982 Pauls et al.
4,364,784 A 12/1982 Van Wersch et al.
4,366,682 A 1/1983 Keller
4,384,867 A * 5/1983 Gruber ..... 8/477
4,385,954 A 5/1983 Pauls et al.
4,387,118 A 6/1983 Shelton
4,400,953 A 8/1983 Driessen et al.
4,402,200 A 9/1983 Clifford et al.
4,435,965 A 3/1984 Sasseville et al.
4,440,808 A 4/1984 Mitter
4,442,771 A 4/1984 Mitter
4,444,104 A 4/1984 Mitter
4,453,462 A 6/1984 Mitter
4,463,467 A * 8/1984 Gruber et al. ..... 8/151
4,463,583 A 8/1984 Krüger et al.
4,474,110 A 10/1984 Rosner
4,497,273 A 2/1985 Mitter
4,498,318 A 2/1985 Mitter
4,501,038 A 2/1985 Otting
4,502,304 A 3/1985 Hopkins
4,534,189 A 8/1985 Clifford
4,552,778 A 11/1985 Zimmer
4,557,218 A 12/1985 Sievers
4,559,243 A 12/1985 Pässler et al.
4,562,097 A 12/1985 Walter et al.
4,571,360 A 2/1986 Brown et al.
4,576,112 A 3/1986 Funger et al.
4,581,254 A 4/1986 Cunningham et al.
4,597,831 A 7/1986 Anderson
4,612,874 A 9/1986 Mitter
4,646,675 A 3/1987 Arthur et al.
4,655,056 A 4/1987 Zeiffer
4,665,723 A 5/1987 Zimmer
4,667,882 A 5/1987 Pacifici
4,731,092 A 3/1988 Berendt
4,734,100 A 3/1988 Berendt et al.
4,741,739 A 5/1988 Berendt et al.
4,762,727 A 8/1988 Voswinckel
4,773,110 A 9/1988 Hopkins
4,778,477 A * 10/1988 Lauchenauer ..... 8/477
4,792,619 A 12/1988 Berendt et al.
4,799,278 A 1/1989 Beeh
4,833,748 A 5/1989 Zimmer et al.
4,872,325 A 10/1989 Moser et al.
4,894,118 A 1/1990 Edwards et al.
4,912,948 A * 4/1990 Brown et al. ..... 118/410
5,008,131 A 4/1991 Bakhshi
5,009,932 A 4/1991 Klett et al.
5,089,296 A 2/1992 Bafford et al.
5,145,527 A 9/1992 Clifford et al.
5,165,261 A 11/1992 Cho
5,219,620 A 6/1993 Potter et al.
5,227,023 A 7/1993 Pounder et al.
5,328,685 A 7/1994 Janchiraponvej et al.
5,340,609 A 8/1994 Arthur et al.
5,366,161 A 11/1994 Potter et al.
5,399,412 A 3/1995 Sudall et al.
5,492,655 A 2/1996 Morton et al.
5,505,997 A 4/1996 Strong et al.
5,510,001 A 4/1996 Hermans et al.
5,552,020 A 9/1996 Smith et al.
5,591,309 A 1/1997 Rugowski et al.
5,605,719 A 2/1997 Tench et al.
5,635,469 A 6/1997 Fowler et al.
5,667,636 A 9/1997 Engel et al.
5,792,737 A 8/1998 Grüning et al.
5,830,483 A 11/1998 Seidel et al.
5,840,403 A * 11/1998 Trokhan et al. ..... 428/154
5,857,627 A 1/1999 Horwell et al.
5,861,143 A 1/1999 Peterson et al.
5,869,075 A 2/1999 Krzysik
5,904,809 A 5/1999 Rokman et al.
5,985,434 A 11/1999 Qin et al.
6,017,417 A 1/2000 Wendt et al.
6,103,128 A 8/2000 Koso et al.
6,132,803 A 10/2000 Kelly et al.
6,238,518 B1 5/2001 Rokman et al.

* cited by examiner

METHOD OF APPLYING A FOAM COMPOSITION ONTO A TISSUE AND TISSUE PRODUCTS FORMED THEREFROM

BACKGROUND OF THE INVENTION

Consumers use paper wiping products, such as tissues, for a wide variety of applications. For example, various types of tissues can be used, such as facial tissues, bath tissues, paper towels, napkins, etc. In many instances, various types of compositions, such as softening compositions, lotions, friction reducing agents, adhesives, etc., are also applied to the tissue. For example, a tissue can be softened through the application of a chemical additive (i.e., softener). However, one problem associated with some conventional softeners is the relative difficulty in applying the softeners to a tissue.

For instance, many softeners are made as an emulsion containing a particular solids content in solution. However, such solutions are often difficult to adequately apply to a tissue. In particular, when applying such a solution, the tissue can become undesirably saturated, thereby requiring the tissue to be dried. Moreover, it is also difficult to uniformly spread the solution on a tissue in such a manner to provide adequate surface area coverage. In addition, some softeners contain components that cause the composition to be formed as a solid or semi-solid. To facilitate application of these compositions onto a tissue, extensive heating may be required. Moreover, even after extensive heating, it may nevertheless be difficult to uniformly apply the composition to the tissue surface.

As such, a need currently exists for an improved method of applying a composition, such as a softening composition, to a tissue.

SUMMARY OF THE INVENTION

The present invention is generally directed to a method of foaming a liquid-based composition onto a tissue. For example, in one embodiment, a liquid-based composition containing a hydrophilic softening composition can be foamed onto a tissue in accordance with the present invention.

A foam composition of the present invention can generally be formulated in a variety of ways. For instance, in one embodiment, the foam composition is formed from a combination of a liquid-based composition and a gas, such as air. Additional components, such as foaming aids, water, odor control agents, etc., can also be incorporated into the liquid-based composition so long as such components do not adversely affect the ability of the liquid-based composition to form into a foam composition.

To form a foam composition from the above-mentioned components, any of a variety of foam generating devices can be utilized. In one embodiment, for example, a foam generator can be utilized that rotates at a certain speed so as to cause the liquid to pass through a series of edges, allowing the trailing eddy currents of air to entrain into the liquid. In particular, one suitable foam generator that can be utilized in the present invention can be obtained from Gaston Systems, located in Stanley, N.C.

When forming the foam composition, it is typically desired that the flow rates of the liquid-based composition stream and the air stream entering the foam generator be controlled. By controlling the flow rates of the foam components, the characteristics of the resulting foam composition may also be controlled. For example, the "blow ratio", i.e., the ratio of air volume to liquid volume, can be maintained at a certain value by controlling the flow rates of the liquid and air streams. Specifically, in most embodiments, the foam composition of the present invention has a blow ratio greater than about 3:1, and particularly between about 5:1 to about 180:1. For example, in one embodiment, the blow ratio can be between about 150:1 to about 180:1, while in another embodiment, the blow ratio can be between about 15:1 to about 25:1.

In addition to the blow ratio, control over the component flow rates can also allow the foam to be generally stable before being applied to the tissue. In particular, the foam composition of the present invention can have a half-life greater than about 3 minutes, particularly between about 3 minutes to about 30 minutes, and more particularly between about 15 minutes to about 25 minutes.

Once the foam composition is formed, it can then generally be extruded onto a moving fibrous web utilizing any of a variety of foam applicators. For example, in one embodiment, a foam applicator having a distribution chamber and an extrusion head can be utilized. In general, the distribution chamber can have any shape or size. In one embodiment, for example, the distribution chamber has a parabolic shape. Moreover, the extrusion head can also generally have any shape or size. For example, in one embodiment, the extrusion head has a straight-slot shape.

By foaming a composition onto a fibrous web in accordance with the present invention, tissue products having a variety of characteristics can be formed. For example, in one embodiment, a tissue having elevated regions and non-elevated regions can be applied with a foam composition of the present invention. In particular, by controlling various characteristics of the foam composition as described herein, the foam can be applied such that the liquid-based composition is uniformly deposited on the elevated regions of the surface of a tissue. Specifically, the liquid composition can be deposited such that a greater amount of the composition resides on the elevated regions of the tissue to impart certain characteristics thereto. In one embodiment, for instance, a hydrophilic, softening composition can be foamed onto the elevated regions of a tissue to provide an improved soft feel to the tissue surface. In some embodiments, the application of the hydrophilic composition to only the elevated regions can allow the tissue to possess discrete hydrophilic portions.

Other features and aspects of the present invention are discussed in greater detail below.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figures in which.

Figure 1:
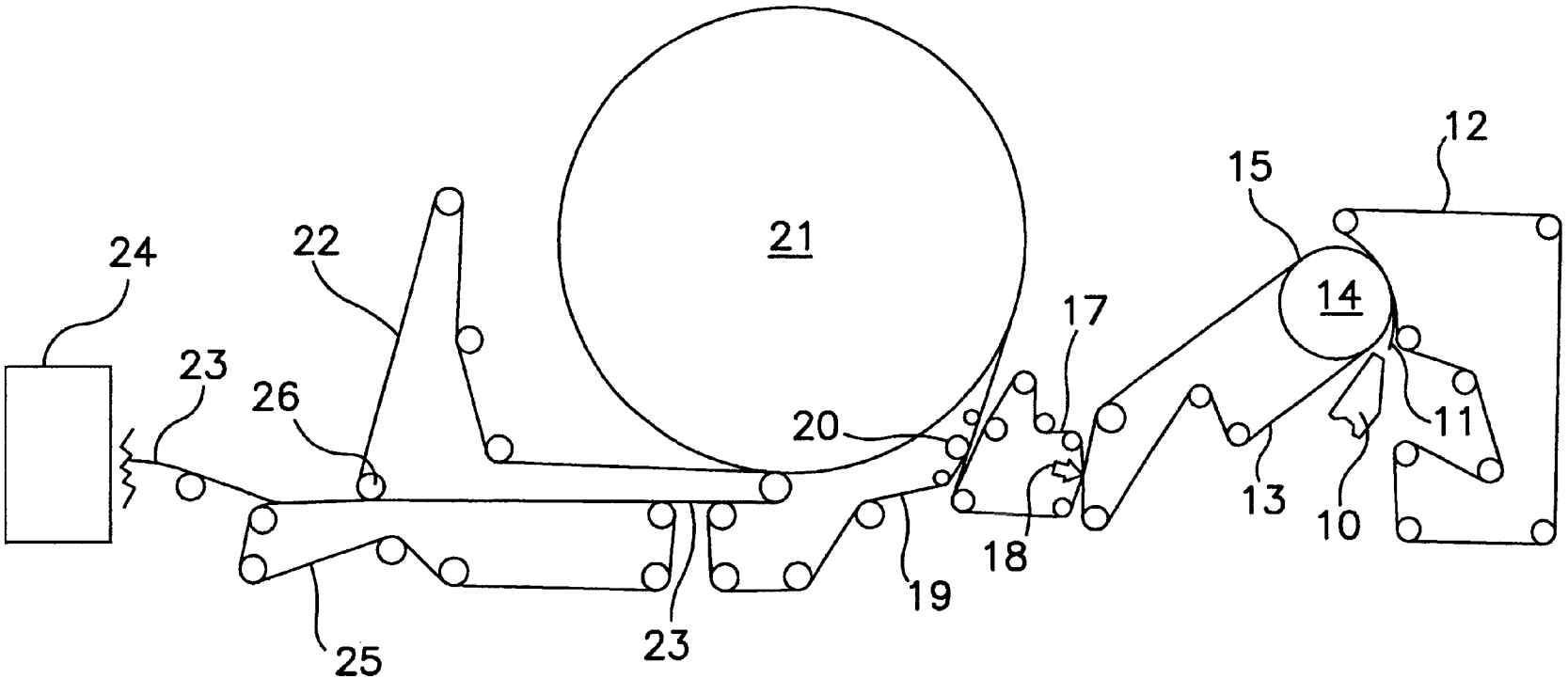
FIG. 1 is a schematic flow diagram of one embodiment of the present invention for forming a tissue.

Repeat use of reference characters in the present specification and drawings is intended to represent same or analogous features or elements of the present invention.

DETAILED DESCRIPTION OF REPRESENTATIVE EMBODIMENTS

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents.

In general, the present invention is directed to a method for applying a foam composition onto a tissue. As used herein, the term "foam" generally refers to a porous matrix, which is an aggregate of hollow cells or bubbles, the walls of which contain liquid material. The cells may be interconnected to form channels or capillaries within the foam structure wherein such channels or capillaries facilitate liquid distribution within the foam. A variety of compositions can be formed into a foam and applied to a tissue in accordance with the present invention. For instance, in one embodiment, a "liquid-based" composition can be foamed onto the tissue. As used herein, a "liquid-based" composition generally refers to any composition that is capable of existing in a liquid state. In particular, a "liquid-based" composition may exist naturally in a liquid state, or may require liquid-enhancing aids, such as heating, foaming aids (e.g., surfactants), etc., to achieve such a liquid state. Moreover, a liquid-based composition also includes emulsions having a certain solids content.

In general, any type of tissue construction can be applied with a foam composition in accordance with the present invention. For example, the tissue can be a single or multiply tissue. Normally, the basis weight of a tissue product of the present invention is less than about 120 grams per square meter, particularly from about 5 grams per square meter to about 50 grams per square meter, and more particularly between about 10 grams per square meter to about 35 grams per square meter. In addition, one or more surfaces of the tissue can be provided with elevated regions (e.g., protrusions, impressions, or domes), such as described in more detail below.

The tissue product can generally be formed from any of a variety of materials. In particular, a variety of natural and/or synthetic fibers can be used. For example, some suitable natural fibers can include, but are not to, nonwoody fibers, such as abaca, sabai grass, milkweed floss fibers, pineapple leaf fibers; softwood fibers, such as northern and southern softwood kraft fibers; and hardwood fibers, such as eucalyptus, maple, birch, aspen, and the like. Illustrative examples of other suitable pulps include southern pines, red cedar, hemlock, and black spruce. Exemplary commercially available long pulp fibers suitable for the present invention include those available from Kimberly-Clark Corporation under the trade designations "Longlac-19". In addition, furnishes including recycled fibers may also be utilized. Moreover, some suitable synthetic fibers can include, but are not limited to, hydrophilic synthetic fibers, such as rayon fibers and ethylene vinyl alcohol copolymer fibers, as well as hydrophobic synthetic fibers, such as polyolefin fibers.

A tissue that can be used in the present invention can generally be formed by any of a variety of papermaking processes known in the art. In particular, it should be understood that the present invention is not limited to any particular papermaking process. In fact, any process capable of forming a paper web can be utilized in the present invention. For example, a papermaking process of the present invention can utilize creping, embossing, wet-pressing, through-drying, through-dry creping, uncreped through-drying, double creping, calendering, as well as other steps in forming the tissue product.

One particular embodiment of the present invention utilizes an uncreped through-drying technique to form the tissue. Examples of such a technique are disclosed in U.S. Pat. No. 5,048,589 to Cook, et al.; U.S. Pat. No. 5,399,412 to Sudall, et al.; U.S. Pat. No. 5,510,001 to Hermans, et al.; U.S. Pat. No. 5,591,309 to Rugowski, et al.; and U.S. Pat. No. 6,017,417 to Wendt, et al., which are incorporated herein in their entirety by reference thereto. Uncreped through-drying generally involves the steps of: (1) forming a furnish of cellulosic fibers, water, and optionally, other additives; (2) depositing the furnish on a traveling foraminous belt, thereby forming a fibrous web on top of the traveling foraminous belt; (3) subjecting the fibrous web to through-drying to remove the water from the fibrous web; and (4) removing the dried fibrous web from the traveling foraminous belt.

For example, referring to FIG. 1, one embodiment of a papermaking machine that can be used in the present invention is illustrated. For simplicity, the various tensioning rolls schematically used to define the several fabric runs are shown but not numbered. As shown, a twin wire former having a papermaking headbox 10 can be used to inject or deposit a stream 11 of an aqueous suspension of papermaking fibers onto the forming fabric 12. With the aid of a roll 14, the fibrous stream 11 is then transferred to a fabric 13, which serves to support and carry the newly-formed wet web 15 downstream in the process as the web 15 is partially dewatered to a consistency of about 10 dry weight percent. Additional dewatering of the wet web can be carried out, such as by vacuum suction, while the wet web is supported by the forming fabric. The headbox 10 may be any tissue-forming headbox used in the art, such as a stratified headbox capable of producing a multilayered web. For example, it may be desirable to provide relatively short or straight fibers in one layer of the basesheet to give a layer with high capillary pressure, while the other layer comprises relatively longer, bulkier, or more curled fibers for high permeability and high absorbent capacity and high pore volume. It may also be desirable to apply different chemical agents to separate layers of a single web to optimize dry and wet strength, pore space, wetting angle, appearance, or other properties of a web. Further, multiple headboxes may be used to create a layered structure, as is known in the art.

The wet web 15 is then transferred from the fabric 13 to a transfer fabric 17 which typically travels at a slower speed than the fabric 13 in order to impart increased stretch into the web. This is commonly referred to as "rush" transfer. One useful method of performing rush transfer is taught in U.S. Pat. No. 5,667,636 to Engel et al., which is incorporated herein in its entirety by reference thereto. The relative speed difference between the two fabrics can be from 0% to about 80%, particularly greater than about 10%, more particularly from about 10% to about 60%, and most particularly from about 10% to about 40%. Transfer may be carried out with the assistance of a vacuum shoe 18 such that the forming fabric and the transfer fabric simultaneously converge and diverge at the leading edge of the vacuum slot.

Thereafter, the web 15 is transferred from the transfer fabric 17 to the through-drying fabric 19 with the aid of a vacuum transfer roll 20 or a vacuum transfer shoe. The through-drying fabric 19 can be traveling at about the same speed or a different speed relative to the transfer fabric 17. For example, if desired, the through-drying fabric 19 can run at a slower speed to further enhance stretch. The vacuum transfer roll or shoe 20 (negative pressure) can be supplemented or replaced by the use of positive pressure from the opposite side of the web to blow the web onto the next fabric.

Figure 4:
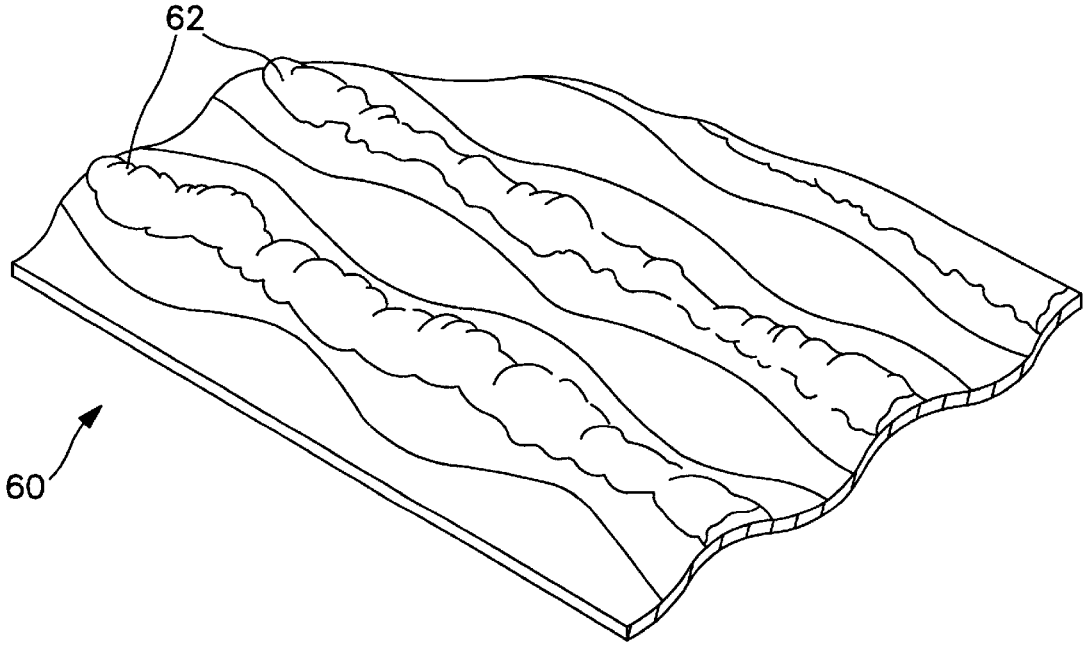
FIG. 4 is a perspective view of a tissue product having elevated regions applied with a foam composition according to one embodiment of the present invention.

In some embodiments, the transfer fabric 19 can be a smoother fabric, such as Asten 934, 937, 939, 959 or Albany 94M. However, in other embodiments, it may be desired to form elevated regions and depressions into the tissue, such as depicted in FIG. 4. To impart such elevated regions, in one embodiment, the transfer fabric 19 can be a fabric having impression knuckles, such as described in U.S. Pat. No. 6,017,417 to Wendt et al. For example, when imprinted with elevations, the resulting tissue can have between about 5 to about 300 protrusions per square inch. Moreover, the protrusions can have a height relative to the plane of the basesheet, as measured in the uncalendered state and uncreped state, of greater than about 0.1 mm, particularly greater than about 0.2 mm, more particularly greater than about 0.3 mm, and in most embodiments, from about 0.25 mm to about 0.6 mm.

Thereafter, the through-dryer 21 can accomplish the removal of moisture from the web by passing air through the web without applying any mechanical pressure. Through-drying can also increase the bulk and softness of the web. In one embodiment, for example, the through-dryer can contain a rotatable, perforated cylinder and a hood (not shown) for receiving hot air blown through perforations of the cylinder as through-drying fabric 19 carries the fibrous web 15 over the upper portion of the cylinder. The heated air is forced through the perforations in the cylinder of the through-dryer 21 and removes the remaining water from the fibrous web 15. The temperature of the air forced through the fibrous web 15 by the through-dryer 21 can vary, but is typically from about 300° F. to about 400° F.

While supported by the through-drying fabric, the web 15 can then be substantially dried, such as, for example, to a consistency of about 94 percent or greater by the through-dryer 21 and thereafter transferred to a carrier fabric 22. The substantially dried web 23 is transported to the foaming system 24, which is described in more detail below, using carrier fabric 22 and an optional carrier fabric 25. An optional pressurized turning roll 26 can be used to facilitate transfer of the web from carrier fabric 22 to fabric 25. Suitable carrier fabrics for this purpose are Albany International 84M or 94M and Asten 959 or 937, all of which are relatively smooth fabrics having a fine pattern. Although not shown, reel calendering or subsequent off-line calendering can be used to improve the smoothness and softness of the basesheet.

Figure 2:
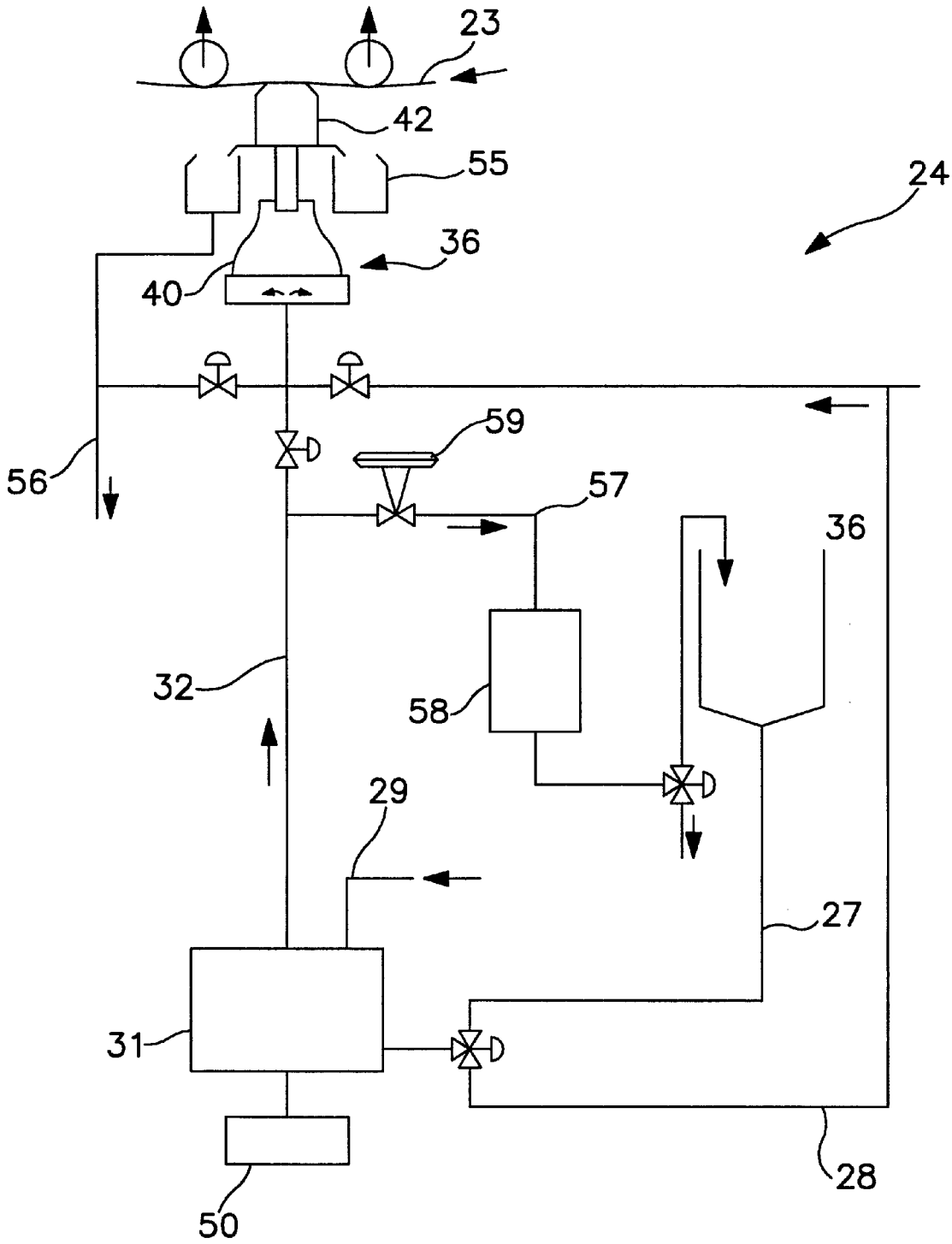
FIG. 2 is a schematic flow diagram of one embodiment of the present invention for foaming a liquid-based composition onto a tissue.

In accordance with the present invention, once a tissue is formed, such as described above, a liquid-based composition can then be foamed thereon. For instance, as shown in FIG. 2, a foaming system 24 can be utilized to foam a composition onto the substantially dried web 23. However, it should be understood that other foaming methods can also be utilized in accordance with the present invention.

Referring to FIG. 2, one embodiment of the foaming system 24 is illustrated schematically. As shown, a foaming system 24 receives a liquid-based chemical composition from a tank 36 that contains a paper-treating additive, such as a softening agent. The chemical composition is supplied to the foaming system 24 through a line 27. In some embodiments, as shown, a line 28 can also be utilized to supply water, recycled liquids, and/or other liquids to the foaming system 24 if desired. Although not required, water may, for example, aid in generating the foamed composition.

In one embodiment, the chemical composition and/or the water can be metered to the foaming system 24 through the use of one or more conventional metering pumps, such as Moyno-style metering pumps. Moreover, in some embodiments, a mixer can also be provided to premix the chemical composition with water before applying the liquids to the foaming system 24.

In addition to a chemical composition and/or water, a gas, such as air, is also generally supplied to the foaming system 24. In particular, as shown, compressed air from a supply tank (not shown) is admitted to the foaming system 24 through a line 29 for mixing with the chemical composition. For example, in one embodiment, compressed air is filtered and then metered into the foaming system 24 through a closed loop thermal mass flow meter and control valve.

Within the foaming system 24, a foam generator 31 combines the air, water (if utilized), and the chemical composition at a certain energy so that the foam can form. In one embodiment, for example, the foam generator 31 rotates at a certain speed so as to cause the liquid to pass through a series of edges, which allow trailing eddy currents of air to entrain into the liquid. In particular, the foam generator 31 can operate at speeds from about 300 rpm to about 700 rpm, and more particularly from about 400 rpm to about 600 rpm. For example, suitable foam generators are described in U.S. Pat. No. 4,237,818 to Clifford, et al., which is incorporated herein in its entirety by reference thereto. Moreover, one commercially available foam generator that can be utilized in the present invention can be obtained from Gaston Systems, located in Stanley, N.C.

After generation, the foam is then forced out of the foam generator 31 into a conduit 32. The diameter of the conduit 32 can vary, depending on the desired amount of generated foam. For instance, in one embodiment, a conduit 32 having an inner diameter between about 0.375 inches to about 1.5 inches can be utilized to process about 300 to about 3000 cubic centimeters of air per minute and about 20 to about 300 grams of liquid per minute. Moreover, the conduit 32 can also have any desired length. For instance, in one embodiment, the length of the conduit 32 can be about 50 feet in length.

At the point in which the foam cells or bubbles enter the conduit 32, they are at their highest pressure. For instance, upon exiting the foam generator, the pressure can be from about 5 psi to about 90 psi, and more particularly from about 30 psi to about 60 psi. For example, in one embodiment, the pressure can be about 30 psi. Thereafter, the foam then travels under pressure through the conduit 32 into the foam applicator 36. As the foam moves up the conduit 32, the system backpressure is generally decreased. Due to this decrease in pressure, the size of the foam bubbles or cells generally increase such that the bubble sizes are greatest at the end of the conduit 32 adjacent to the foam applicator 36. In some embodiments, if desired, foam bubbles generated by the foam generator 31 can be recycled through the system 24 through a line 57, which utilizes a slot pressure control valve 59 to force the bubbles through a foam separator 58 that separates the liquid-based composition from the foam for further use.

Figure 3:
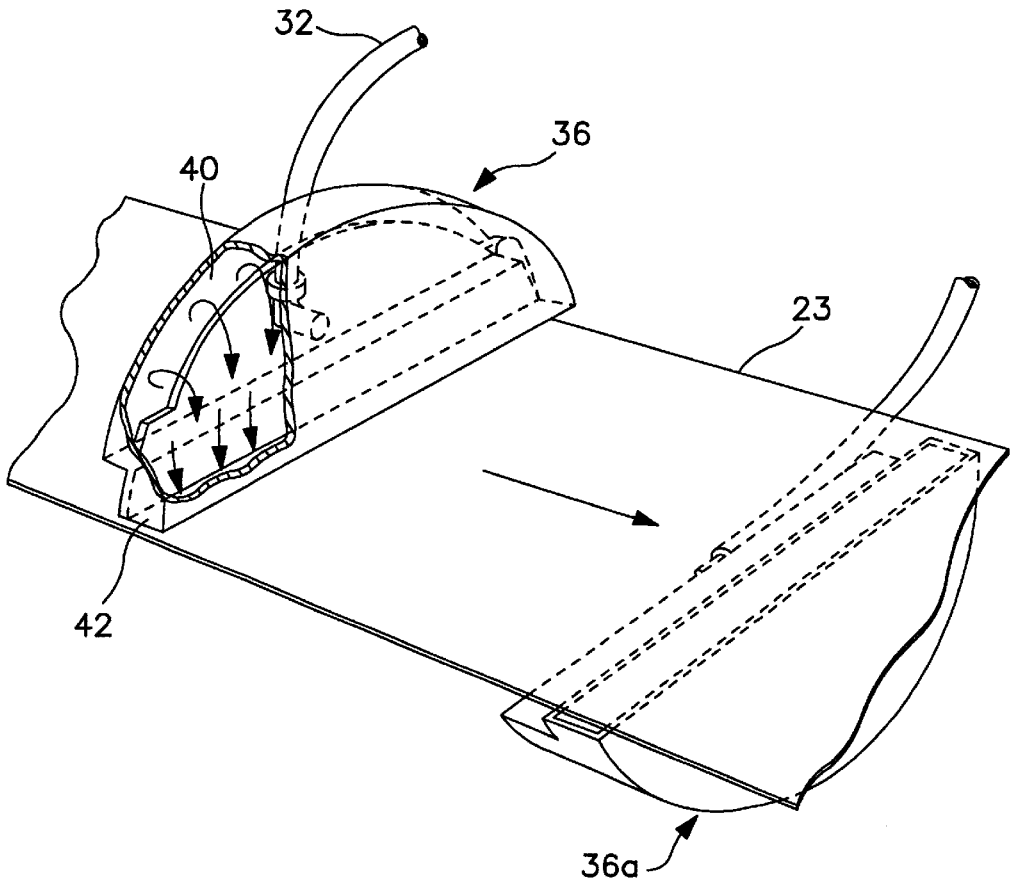
FIG. 3 is a perspective view of one embodiment of top and bottom foam applicators used to foam a composition onto a tissue in accordance with the present invention.

Referring to FIG. 3, one embodiment of a foam applicator that can be utilized in the present invention is illustrated. As shown, the foam applicator 36 contains a distribution chamber 40 and an extrusion head 42. Any of a variety of distribution chambers and/or extrusion heads can be utilized in a foam applicator of the present invention.

For example, as shown, in one embodiment, the distribution chamber 40 is substantially parabolic in shape. In this embodiment, the substantially parabolic shape can allow the foam bubbles to travel the same distance, at the same velocity, for the same length of time, thereby enhancing the uniformity of foam application. It should be understood, however, that the present invention is not limited to any specific distribution chamber design. For example, one example of a suitable distribution chamber is described in U.S. Pat. No. 4,237,818 to Clifford. et al., which is incorporated herein in its entirety by reference thereto.

As the foam enters the distribution chamber 40 from the conduit 32, it is initially forced upward to assure that any decaying foam collects therein for automatic draining. Thereafter, it is forced downward, as indicated by the arrows in FIG. 3, through the distribution chamber 40 to the extrusion head 42. In general, extrusion heads having any of a variety of shapes and sizes can be used in the present invention. For example, in one embodiment, "straight slot" extrusion heads, such as disclosed in U.S. Pat. No. 4,237,818 to Clifford, et al. and U.S. Pat. No. 4,581,254 to Cunnigham, et al., which are incorporated herein in their entirety by reference thereto, can be utilized. As used herein, a "straight slot" extrusion head generally refers to an application head having parallel nozzle bars. In one embodiment, for example, a "straight slot" extrusion head includes two parallel nozzle bars that form an extrusion slot which is generally between about 0.025 inches to about 0.5625 inches in width, and in some embodiments, between about 0.050 inches to about 0.0626 inches in width. For instance, in one embodiment, the width is about 0.125 inches. In another embodiment, the width is about 0.1875 inches.

Moreover, the length of the bars are typically such that the extrusion slot has a length from about 0.125 inches to about 6 inches. The length of the slot, however, can be varied as desired to adjust the web handling land area. For example, in one embodiment, the length of the extrusion slot can be about 0.187 inches. In addition, a wiper plate can also be attached to one or both of the nozzle bars to help adhere the foam to the web.

If desired, one or both of the upper lips of the parallel bars of the extrusion head can also be configured to apply a certain amount of tension to the web when contacted therewith. For instance, in one embodiment, as a web is pulled over the foam applicator, it first contacts a first upper lip of one parallel nozzle bar and then contacts a second upper lip of the other parallel nozzle bar. As the web is pulled over the first and second upper lips, foam can be applied to the bottom surface of the web through the extrusion slot defined by the parallel nozzle bars.

In general, the size of the upper lips can be varied as desired. For instance, the upper lips can have a radius up to about 0.50 inches. In some embodiments, it may be desired to utilize a first upper lip having a relatively narrow radius, such as less than about 0.01 inches, and more particularly less than about 0.05 inches. By utilizing a relatively narrow first upper lip, a high pressure point can be created. This high pressure point allows the "boundary air layer" located directly below the web to be minimized. As used herein, a "boundary air layer" generally refers to a layer of air located adjacent to a moving web. Because webs used in tissue formation typically have relatively low basis weights and strengths, boundary air layers often inhibit the ability to control the position of the traveling web. As such, by minimizing the boundary air layer, such as described above, the efficiency of foam application can be enhanced. It should be understood that various other mechanisms can be utilized to minimize the boundary air layer. For example, in some embodiments, vacuum rolls or boxes can be utilized to remove the boundary air layer.

Moreover, it should also be understood that any method or apparatus for applying a foam to a web can be used in the present invention, and that the foam applicator depicted and described herein is for illustrative purposes only. For instance, some suitable foam applicators are described in U.S. Pat. No. 4,237,818 to Clifford, et al. and U.S. Pat. No. 4,581,254 to Cunnigham, et al.

Referring to FIG. 3, the foam is generally extruded onto the moving tissue web 23 from the extrusion head 42, as described above. In particular, by exerting sufficient tension in the moving tissue web, the tissue can generally be kept in uniform contact with the upper surfaces of the head 42 against the pressure of the foam within the head 42. Thus, as it moves, the tissue web 23 can "tear away" portions of the foam bubbles located near the upper surfaces of the head 42. Moreover, small portions of the foam bubbles can also be blown onto the web. Specifically, the foam bubbles remain under pressure until the instant of application to tissue web 23 so that the liquid forming the bubbles can be blown onto the substrate by the rapidly expanding air released from the bubbles. In some embodiments, excess foam can also be collected by collection troughs 55 and recycled through a line 56.

Although the use of only one foam applicator 36 is described in detail herein, it should be understood that any number of foam applicators may be used. For instance, as shown in FIG. 3, a first foam applicator 36 is shown as depositing a foam composition onto the top surface of the web 23, while a second applicator **36*a* is shown as depositing a foam composition on the bottom surface of the web 23. The foam applicator 36*a* may be the same or different than the foam applicator 36. Moreover, although not required, it is typically desired that the foam applicators 36 and 36*a* be positioned in a staggered configuration so that the web 23 can be better deflected around the applicators. It should also be understood that other applicators can be utilized in conjunction with the applicators 36 and 36*a* to deposit foam compositions onto the top and/or bottom surfaces of the web 23**.

In general, any of a variety of process parameters may be controlled to ensure adequate foaming. For example, process parameters, such as tissue web traverse speed, web tension, tissue basis weight, etc., may be controlled. For instance, in one embodiment, the web traverse speed can be greater than about 300 feet per minute, and particularly between about 300 feet per minute to about 2500 feet per minute.

Moreover, the flow rates of the chemical composition, air, and/or water can also be controlled. By controlling the flow rates of air, water, and/or the chemical composition stream, certain characteristics of the generated foam can be selectively varied as desired. For example, control over these flow rates can be utilized to control the "blow ratio" of the resulting foamed composition. As used herein, the "blow ratio" generally refers to the ratio of air volume to liquid volume in the foam. In particular, the blow ratio represents the volume of air that a given liquid can support. For example, a relatively high blow ratio is generally associated with foam bubbles having a smaller wall thickness. On the other hand, a relatively low blow ratio is generally associated with foam bubbles having a larger wall thickness. In most embodiments, it is typically desired that a relatively high blow ratio be utilized in the present invention. For example, although not required, a foam generation system of the present invention can utilize blow ratios greater than about 3:1, and particularly from about 5:1 to about 180:1. For example, in some embodiments, a blow ratio of about 150:1 to about 180:1 is utilized, while in other embodiments, a blow ratio of about 15:1 to about 25:1 is utilized. For instance, in one particular embodiment, a blow ratio of about 30:1 is obtained from a liquid flow rate of 113 grams per minute and an air flow rate of 3831 cubic centimeters per minute. In another embodiment, a blow ratio of about 20:1 was obtained from a liquid flow rate of 248 grams per minute and an air flow rate of 4800 cubic centimeters per minute.

In addition, the flow rates of the air, water, and/or the chemical composition can also be controlled to ensure that the resulting foam is "generally stable". As used herein, a "generally stable" foam generally refers to a foam that does not substantially dewater or collapse from the time it is generated to the time it is applied to the tissue. For example, a generally stable foam typically has a "half-life" that allows the foam to travel from the foam generator to the applicator before degenerating. For instance, a foam bubble of the present invention can have a half-life of greater than about 3 minutes, particularly from about 3 minutes to about 30 minutes, and more particularly from about 15 minutes to about 25 minutes.

The half-life of the foam can generally be determined in the following manner. A calibrated beaker is positioned on a scale and placed under a 500 cubic centimeter separator funnel. Approximately 50 grams of a foam sample is then collected into the separator funnel. As soon as all of the foam is placed in the funnel, a standard stop watch is started. When approximately 25 grams of liquid collects into the calibrated beaker, the time is stopped and recorded. This recorded time is the foam half-life.

In some instances, the average cell size, wall thickness, and/or density may also foster the stability of the foam. For instance, the foam can have a size, thickness, or density such as described in U.S. Pat. No. 4,099,913 to Walter et al. and U.S. Pat. No. 5,985,434 to Qin, et al., which are both incorporated herein in their entirety by reference thereto. For example, in one embodiment, the average cell size of the foam cell can be between about 10 microns to about 100 microns. Moreover, the average wall thickness of the foam cell can be between about 0.1 micron to about 30 microns.

Besides ensuring adequate foam generation, various process parameters can be selectively varied to allow control over the penetration of the foam composition into the tissue web. For example, in one embodiment, the process parameters can be controlled to allow the liquid based composition to be uniformly deposited on the elevated regions of the surface of a tissue. Specifically, as shown in FIG. 4, a liquid-based composition can be deposited such that a greater amount of the composition resides on the elevated regions 62 of a tissue 60 than on the non-elevated regions to impart certain characteristics to the tissue. For instance, a hydrophilic, softening composition, such as described in more detail below, can be foamed onto the elevated regions of a tissue to provide an improved soft feel to the tissue surface.

As shown in FIG. 2, a system controller 50 can also be provided to control the process parameters of the foaming system. In particular, various controlled, controlling, and monitoring elements can be placed in communication with the system controller 50. For instance, although not depicted, solenoid valves, other valves, pumps, the foam generator, flowmeters, transducers, and the like, can all be placed in communication with the controller 50. In one embodiment, for example, the flow rates of the chemical composition, water, and/or air being supplied to the foam generator system 24, can be controlled by the controller 50.

In accordance with the present invention, as stated above, various liquid-based compositions can generally be foamed onto a tissue. For example, in one embodiment, a liquid-based softening composition can be foamed onto the tissue to impart a soft feel to the tissue. In this regard, various embodiments of a softening composition that can be foamed onto a tissue in accordance with the present invention will now be described. It should be understood, however, that various other compositions, such as adhesives used to attach multiple plies of tissue, and/or other liquid-based compositions may be used in accordance with the present invention. Moreover, it should be understood that the following components, concentration ranges, and parameters can widely vary depending upon the particular application.

Accordingly, one embodiment of a liquid-based softening composition that can be foamed onto a tissue in accordance with the present invention includes a silicone polymer, a surfactant, a softness-enhancing agent, and a solvent.

The liquid-based softening composition can generally contain any of a variety of different silicone polymers. In some embodiments, the silicone polymer can be cationic such that it is more substantive to the cellulosic fibers of certain substrates, such as tissue products. In particular, because a tissue typically contains cellulosic fibers that are anionic in nature, a cationic silicone polymer can allow the softening composition to more easily bond to the tissue. Moreover, a cationic silicone polymer can also enhance the ability of the cellulosic fibers of the tissue to retain other non-cationic components, such as non-ionic surfactants. In certain instances, the silicone polymer can also contain antistatic properties to enhance the lubricating and conditioning affect of the composition. Further, the silicone polymer can also aid in improving the softness and water solubility and/or dispersibility of the tissue.

In some instances, the silicone polymer has one or more amino groups that are linked together by various elements. For example, diquaternary and polyquaternary ammonium compounds can be used as the silicone polymer. Particular examples of silicone polymers that can be used in a softening composition of the present invention are silicone diquaternary ammonium salts. For instance, one embodiment of a silicone diquaternary ammonium salt that can be used in the present invention is shown below as formula (1):

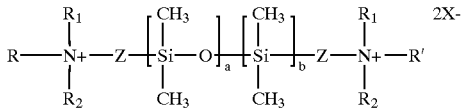

wherein, a, b≧0 and a+b≧1;

$R_1$ and $R_2$ are independently selected from $C_1$–$C_6$ alkyls and $C_1$–$C_6$ hydroxyalkyls. In general, the $C_1$–$C_6$ alkyls and/or $C_1$–$C_6$ hydroxyalkyls may be linear or branched. Moreover, although not required, in some embodiments, the $C_1$–$C_6$ alkyls and/or $C_1$–$C_6$ hydroxyalkyls may be substituted with any of a variety of substituents;

wherein R and R' are independently selected from $C_8$–$C_{24}$ aliphatic hydrocarbons. In general, the $C_8$–$C_{24}$ aliphatic hydrocarbons may be linear or branched. Moreover, although not required, in some embodiments, the $C_8$–$C_{24}$ aliphatic hydrocarbons may be substituted with any of a variety of substituents;

wherein Z is a substituent containing the following formula (2):

$$—(CH_2)_j—CHOH—CH_2—O—(CH_2)_k—$$

where $j \geqq 1$ and $k \geqq 1$;

and wherein X can be selected from any suitable ion, such as chloride, methylsulfate, ethylsulfate, acetate, lactate, etc.

Depending on the desired characteristics of the tissue, the silicone polymer can be incorporated within the softening composition in various amounts. In particular, the silicone polymer can be utilized in the softening composition in amounts up to about 40% by weight of the composition. In some embodiments, the silicone polymer comprises from about 15% to about 30% of the weight of the softening composition.

As stated, the above-mentioned liquid-based softening composition also generally includes a surfactant. As used herein, a "surfactant" generally refers to a surface-active substance that can reduce surface tension. The surfactant can be non-ionic, ionic, cationic, or amphoteric. In general, the surfactant is capable of reducing the surface tension of the softening composition, thereby rendering a more stable composition. In particular, non-ionic surfactants, such as silicon polyethers, are particularly useful when incorporated into a composition of the present invention. For example, one suitable non-ionic silicon polyether compound can include a dimethicone polyol, such as shown below as formula (3):

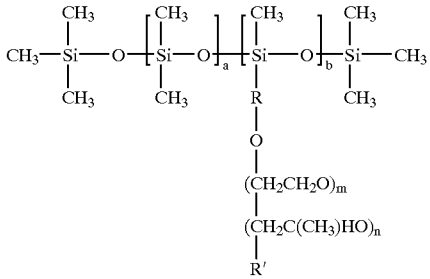

wherein, a, $b \geqq 1$;

R is selected from $C_1$–$C_6$ alkyls and $C_1$–$C_6$ hydroxyalkyls. In general, the $C_1$–$C_6$ alkyls and $C_1$–$C_6$ hydroxyalkyls may be linear or branched. Moreover, although not required, in some embodiments, the $C_1$–$C_6$ alkyls and $C_1$–$C_6$ hydroxyalkyls may be substituted with any of a variety of substituents;

wherein R' is selected from hydrogen, $C_1$–$C_6$ alkyls, and $C_1$–$C_6$ hydroxyalkyls. In general, the $C_1$–$C_6$ alkyls and/or $C_1$–$C_6$ hydroxyalkyls may be linear or branched. Moreover, although not required, in some embodiments, the $C_1$–$C_6$ alkyls and $C_1$–$C_6$ hydroxyalkyls may be substituted with any of a variety of substituents;

wherein m is between about 1 to about 500; and n is between about 0 to about 300.

In some embodiments, the "m/n ratio" can be adjusted to control the water absorption characteristics or hydrophilicity of the surfactant. As used herein, the "m/n ratio" refers generally to the ratio of propyoxylate groups (i.e., $—CH_2—C(CH_3)HO—$) to ethyoxylate groups (i.e., $—CH_2—CH_2—O—$) in a dimethicone copolyol component as shown above in formula (3). In particular, by decreasing the n/m ratio, the resulting dimethicone copolyol can become more hydrophilic (i.e., having an affinity for water). In turn, a softening composition that is incorporated with the relatively hydrophilic dimethicone polyol can also be made to be more compatible with an aqueous environment. As a result, because the composition has some affinity for water, it can generally be applied to a tissue without causing a substantial decrease in the absorbency (i.e., hydrophilic) properties of the tissue. In this regard, the m/n ratio of a dimethicone polyol used in the softening composition can, in some embodiments, be less than about 1, particularly less than about 0.50, and more particularly less than about 0.25. For example, in one embodiment, the dimethicone copolyol is formulated to have a n/m ratio of 0.25, wherein m is about 80 and n is about 20. In another embodiment, the n/m ratio can be about 0.67 where m is about 60 and n is about 40.

In general, the surfactant can be incorporated within the softening composition in various amounts. In particular, the surfactant is typically utilized in the softening composition in amounts up to about 20% by weight of the composition. In some embodiments, the surfactant comprises from about 5% to about 15% of the weight of the softening composition.

In addition, the molecular weight of the surfactants utilized can also vary. For instance, dimethicone copolyols having a higher molecular weight (e.g., greater than about 10,000) tend to feel tacky, while dimethicone polyols having a lower molecular weight (e.g., less than about 8,000) tend to feel slippery or silky. The molecular weight may affect other properties as well, such as intrinsic viscosity, emulsifying capability, etc. Thus, to achieve a tissue having a particularly desired hand feel, the molecular weight of the surfactant can be selectively varied. For example, in some embodiments, the molecular weight of the surfactant can range from about 400 to about 20,000, particularly from about 500 to about 10,000, and more particularly from about 1,000 to about 8,000. Moreover, besides, or in conjunction with varying the molecular weight of the surfactant, the m/n ratio can also be varied, as stated above, to further assist the attainment of a particular hand feel.

Further, in some embodiments, the surfactant can be appropriately selected so that its "cloud point" is controlled. As used herein, the "cloud point" refers generally to the temperature at which a material will precipitate out of solution. By controlling the cloud point of the surfactant, the softening composition can be made more compatible with foam application. In particular, the cloud point of the surfactant is typically maximized to ensure adequate foaming. For example, dimethicone copolyols having a cloud point greater than about 20° C. can be utilized in one embodiment of the present invention. In particular, dimethicone polyols having a cloud point greater than about 30° C., and more particularly greater than about 50° C., can be utilized. One example of such a surfactant is Abil B8843 (cloud point is greater than about 85° C. and the n/m ratio is 0 where n 0 and m=100) made by Goldschmidt Corp.

In addition to a surfactant and a silicone polymer, the softening composition also generally includes a softness-enhancing agent. Softness-enhancing agents can provide numerous benefits to the softening composition. For instance, the agents can further enhance the hand feel or softness of a tissue when applied thereto. Moreover, these agents can also aid in formulating the softening composition by aiding in solubilizing, stabilizing, emulsifying, suspending, dispersing, etc. Further, in some embodiments, cationic and/or amphoteric agents can enhance the ability of the softening composition to bond to cellulosic fibers of the tissue. In some embodiments, agents can be utilized that also act as anti-microbial agents, some of which are described in more detail below.

In general, any of a wide variety of softness-enhancing agents can be utilized in the softening composition. For instance, some suitable softness-enhancing agents can include, but are not limited to, quaternary ammonium compounds, imidazolinium compounds, bis-imidazolinium compounds, diquaternary ammonium compounds, polyquaternary ammonium compounds, phospholipids, fatty acid esters of sorbitan and sugar, for example, combinations thereof, and the like. Some specific examples of suitable softness-enhancing agents are given below:

1. Quaternary ammonium compounds having the following basic structure:

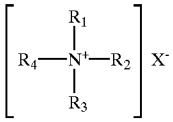

wherein

X=halide, methyl sulfate, ethyl sulfate, lactate, or other compatible counterion;

R1 can be hydrogen, $C_1$–$C_6$ alkyl or hydroxyalkyl; and

R2, R3, R4 can be the same or different, any linear or branched, saturated or unsaturated, substituted or non-substituted, with or without ethoxylation, with or without propoxylation, aliphatic hydrocarbon moiety of greater than 8 carbon chain length, preferably between 8–30 carbon chain length;

or

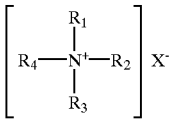

wherein

X=halide, methyl sulfate, ethyl sulfate, lactate, or other compatible counterion;

R1, R2 can be the same or different, hydrogen, $C_1$–$C_6$ alkyl or hydroxyalkyl; or R1 can be hydrogen, $C_1$–$C_6$ alkyl or hydroxyalkyl;

R2 can be benzyl or epoxy; and

R3, R4 can be the same or different, any linear or branched, saturated or unsasturated, substituted or non-substituted, with or without ethoxylation, with or without propoxylation, aliphatic hydrocarbon moiety of greater than 8 carbon chain length, preferably between 8–30 carbon chain length;

or

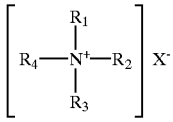

wherein

X=halide, methyl sulfate, ethyl sulfate, lactate, or other compatible counterion;

R1, R2, R3 can be the same or different, hydrogen, $C_1$–$C_6$ alkyl or hydroxyalkyl; R4 can be any linear or branched, saturated or unsasturated, substituted or non-substituted, with or without ethoxylation, with or without propoxyl ation, aliphatic hydrocarbon moiety of greater than 8 carbon chain length, preferably between 8–30 carbon chain length.

2. Quaternary ammonium compounds having the following basic structure:

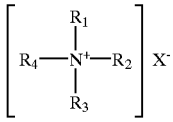

wherein

X=halide, methyl sulfate, ethyl sulfate, lactate, or other compatible counterion;

R1, R2, R3 can be the same or different, hydrogen, $C_1$–$C_6$ alkyl or hydroxyalkyl; and R4 are selected from any of the following two groups:

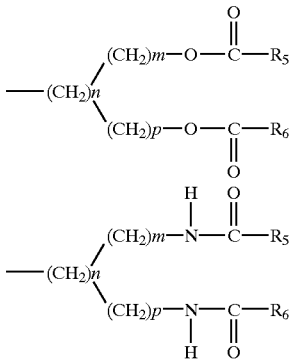

$n$ = 2–6;
$m$ = 0–6
$p$ = 1–6; and
R5, R6 can be the same or different, any linear or branched, saturated or unsasturated, substituted or non-substituted, with or without ethoxylation, with or without propoxylation, aliphatic hydrocarbon moiety of greater than 8 carbon chain length, preferably between 8–30 carbon chain length or

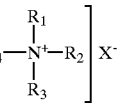

wherein

X=halide, methyl sulfate, ethyl sulfate, lactate, or other compatible counterion;

R1, R2 can be the same or different, hydrogen, $C_1$–$C_6$ alkyl or hydroxyalkyl; and R3, R4 can be selected in any combination from the following two groups:

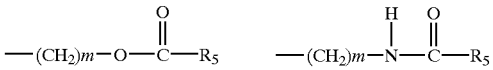

*m* = 2–6; and

R5 can be any linear or branched, saturated or unsasturated, substituted or non-substituted, with or without ethoxylation, with or without propoxylation, aliphatic hydrocarbon moiety of greater than 8 carbon chain length, preferably between 8–30 carbon chain length.

3. Quaternary ammonium compounds having the following basic structure:

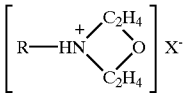

wherein

X=halide, methyl sulfate, ethyl sulfate, lactate, or other compatible counterion;

R is selected from the following group:

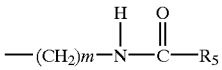

*m* = 2–6; and

R5 can be any linear or branched, saturated or unsaturated, substituted or non-substituted, with or without ethoxylation, with or without propoxylation, aliphatic hydrocarbon moiety of greater than 8 carbon chain length, preferably between 8–30 carbon chain length.

4. Imidazolinium compounds having the following basic structures:

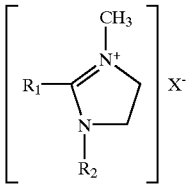

wherein

X=halide, methyl sulfate, ethyl sulfate, lactate, or other compatible counterion;

R1 can be any linear or branched, saturated or unsaturated, substituted or non-substituted, with or without ethoxylation, with or without propoxylation, aliphatic hydrocarbon moiety of greater than 8 carbon chain length, preferably between 8–30 carbon chain length; and R2 can be selected from any of the following two groups:

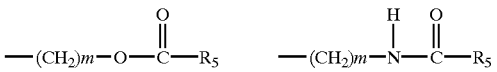

-continued

*m* = 2–6; and

R5 can be any linear or branched, saturated or unsaturated, substituted or non-substituted, with or without ethoxylation, with or without propoxylation, aliphatic hydrocarbon moiety of greater than 8 carbon chain length, preferably between 8–30 carbon chain length.

5. Bis-imidazolinium compounds having the following basic structure:

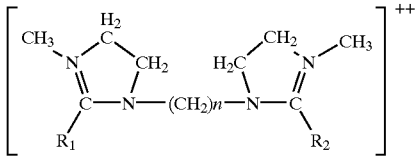

wherein

X=halide, methyl sulfate, ethyl sulfate, lactate, or other compatible counterion;

R1, R2 can be the same or different, aliphatic hydrocarbons, linear or branched, saturated or unsaturated, substituted or non-substituted, with or without ethoxylation, with or without propoxylation, preferably $C_8$–$C_{30}$; or R1, R2 can be selected in any combination from any of the following two groups:

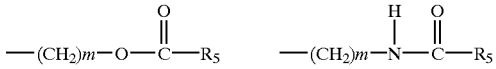

*m* = 2–6; and

R5 can be any linear or branched, saturated or unsaturated, substituted or non-substituted, with or without ethoxylation, with or without propoxylation, aliphatic hydrocarbon moiety of greater than 8 carbon chain length, preferably between 8–30 carbon chain length.

6. Diquaternary ammonium compounds having the following basic structure:

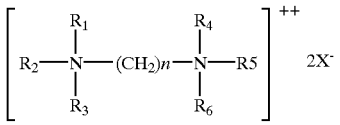

wherein

X=halide, methylsulfate, ethylsulfate or other compatible counterion;

n=2–8;

R, R4 may be the same or different, are H, $CH_3$, or $(CH_2)_mOH$ where m=1–4;

R2, R3, R5, R6 may be the same or different, are from the following groups:

(i). —$(CH_2)_p$ OH, where p=1–6;

or (ii).

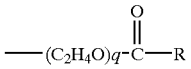

where q=1–10, R=aliphatic, $C_8$–$C_{30}$, saturated or unsaturated, normal or branched;

or (iii).

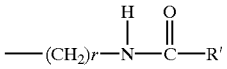

where r=1–10, R'=aliphatic, $C_8$–$C_{30}$, saturated or unsaturated, normal or branched;

or (iv).

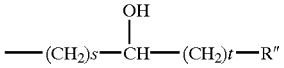

where s=1–10, t=1–4, R"=aliphatic, $C_8$–$C_{30}$, saturated or unsaturated, normal or branched.

7. Polyquaternary ammonium compounds having the following basic structure:

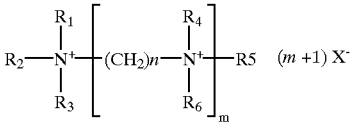

wherein

X=halide, methylsulfate, ethylsulfate or other compatible counterion;

n=2–8;

m=1 or greater;

R2, R5 may be the same or different, are aliphatic, $C_8$–$C_{30}$, saturated or unsaturated, normal or branched; or $(CH_2)_q$—CHOH—R' where q=1–6, and R'=aliphatic, $C_8$–$C_{30}$, saturated or unsaturated, normal or branched; or $(CH_2)_r$—O—R" where r=1–6, and R"=aliphatic, $C_8$–$C_{30}$, saturated or unsaturated, normal or branched; and R1, R4, R3, R6 may be the same or different, are H, $CH_3$, or $(CH_2)_mOH$ where m=1–6; or aliphatic, $C_8$–$C_{30}$, saturated or unsaturated, normal or branched.

8. Phospholipid Derivatives having the following basic structure:

(1)

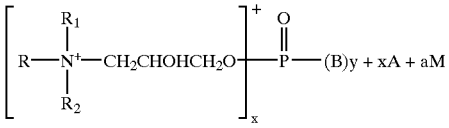

wherein, x=1–3;

x+y=3;

a=0–2;

B=O⁻ or OM;

A=an anion;

M=a cation;

R, R1, R2 can be the same or different, are alkyl, substituted alkyl, alkyl aryl or alkenyl groups of up to 30 carbon atoms;

or (2)

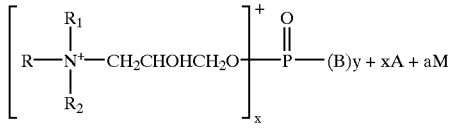

wherein x=1–3;

x+y=3;

a=0–2;

B=O⁻ or OM;

A=an anion;

M=a cation;

R1, R2 can be the same or different, are alkyl, hydroxyalkyl, carboxyalkyl, $C_1$–$C_6$, or propoxyalkylene, $C_1$–$C_{10}$; or R1, R2 and the nitrogen they are attached to may represent an N-heterocycle; and R has the following structure:

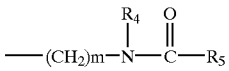

wherein m=2–6;

R4=hydrogen or alkyl, hydroalkyl or alkenyl of up to 6 carbon atoms, or cycloalkyl of up to 6 carbon atoms or polyoxyalkylene; and R5=alkyl, alkenyl, alkoxy or hydroxyalkyl, C5–C30, or aryl or alkylaryl of up to C30.

or (3)

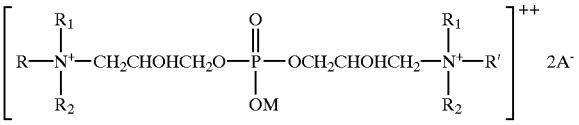

wherein

A=an anion;

M=a cation;

R, R1, R2 can be the same or different, are alkyl, substituted alkyl, alkyl aryl or alkenyl groups of up to 30 carbons; and R' has the following structure:

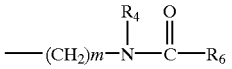

wherein m=2–6;

R4=hydrogen or alkyl, hydroalkyl or alkenyl of up to 6 carbon atoms, or cycloalkyl of up to 6 carbon atoms or polyoxyalkylene; and R6 has the following structure:

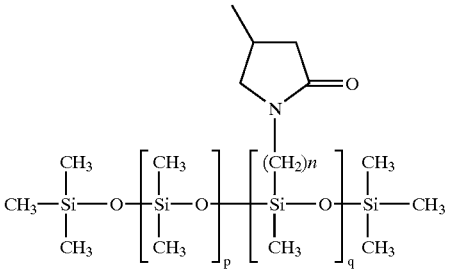

where n≧3;

p=1–1000; and q=1–25.

9. Fatty acid esters of sorbitan and sugar having the following basic structures:

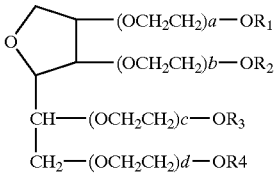

wherein $R_1$=Hydrogen $R_2$ $R_3$ $R_4$ may be the same of different, can be hydrogen, or of the following structure:

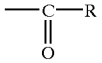

wherein

R is selected from any linear or branched, saturated or unsaturated, substituted or non-substituted alkyl or aliphatic hydrocarbon moiety of greater than 6 carbon chain length, preferably between 8–30 carbons, and more preferably between 12–24 carbons.

or (2).

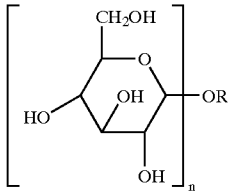

wherein n≧0, and

R can be selected from any linear or branched, saturated or unsaturated, substituted or non-substituted alkyl or aliphatic hydrocarbon moiety of greater than 6 carbon chain length, preferably between 8–30 carbons, and more preferably between 12–24 carbons.

Regardless of the particular softness-enhancing agent utilized in the softening composition, it is typically desired that the softness-enhancing agent contains between 8 to 24 carbon atoms in its carbon chain length (i.e., $C_8$–$C_{24}$), particularly having a carbon chain length of $C_{12}$–$C_{24}$, and more particularly, a carbon chain length of $C_1$–$C_{24}$. For example, in one embodiment of the present invention, a softness-enhancing agent having a carbon chain length of $C_{22}$ is utilized as the softness-enhancing agent.

Moreover, a softness-enhancing agent of the present invention can also generally be incorporated within the softening composition in various amounts. In particular, a softness-enhancing agent can be utilized in the softening composition in amounts up to about 20% by weight of the composition. In some embodiments, the softness-enhancing agent comprises from about 5% to about 15% of the weight of the softening composition.

As stated, the softening composition also contains a solvent. For instance, in one embodiment, water and/or any of a variety of alcohol-based compounds can be utilized as a solvent of the softening composition. In particular, some solvents that are suitable for use in the present invention include, but are not limited to, water, methanol, ethanol, propanol, isopropanol, glycerin, propylene glycol, ethylene glycol, polypropylene glycol, polyethylene glycol, 1,3-methyl propanediol, isopentyldiol, etc.

In general, the solvent can be incorporated within the softening composition in various amounts. In particular, the solvent can be utilized in the softening composition in amounts up to about 40% by weight of the composition. In some embodiments, the solvent compound comprises from about 15% to about 30% of the weight of the softening composition.

To form the softening composition, the silicone polymer, surfactant, softness-enhancing agent, solvent, and any other additional ingredients can be blended together in a variety of ways. For instance, in one embodiment, the ingredients are blended with moderate agitation for about 5 to about 10 minutes. The resulting formulation is a liquid that can generally stand at room temperature for substantial amounts of time without re-solidifying. In some embodiments, such as when utilizing softness-enhancing agents having a carbon chain length greater than $C_{18}$, some initial heating may be required. After initial heating, the melted components can then be added to the other liquid components and mixed therewith.

In addition, the softening composition can also generally be formed as a liquid at room temperature. Moreover, the composition can also generally remain a liquid for an extended period of time without substantially re-solidifying. In particular, softness-enhancing agents having a relatively long carbon chain length (i.e., greater than about $C_{18}$) typically impart a solid or semi-solid state to compositions. However, when utilized in accordance with the present invention, such agents do not generally result in the formation of a semi-solid or solid softening composition. Nevertheless, it should be understood that, in certain instances, the particular components of the composition may require some initial heating to achieve a liquid state. For example, in some embodiments, softness-enhancing agents having a carbon chain length greater than $C_{18}$ may require some heating before being added.

Besides the components mentioned above, a variety of other materials can also be utilized in conjunction with a liquid-based composition, e.g., softening composition, that is foamed onto a tissue in accordance with the present invention. In fact, any material can be added to the composition as long as the material does not substantially affect the ability of the composition to impart softness to a tissue product. In particular, a liquid-based composition can often act as an effective carrier for various active ingredients desired to be applied to a tissue product.

For example, in one embodiment, a variety of foaming aids can be applied to the softening composition. Foaming aids can be useful in facilitating the generation of foam from a softening composition. A foaming aid can also be useful in stabilizing existing foam. In general, any of a variety of foaming aids can be applied to the softening composition. In particular, foaming aids that have a low critical miscelle concentration, are cationic and/or amphoteric, and have small bubble sizes are typically utilized. Some examples of suitable foaming aids include, but are not limited to, fatty acid amines, amides, and/or amine oxides; fatty acid quaternary compounds; electrolytes (to help achieve foam stability); and the like. Some commercially available foaming aids that are suitable in the present invention are Mackernium 516 and Mackam CBS-50G made by McIntyre Group, Ltd. When utilized, the foaming aids are generally incorporated into the softening composition in amounts up to about 20% by weight, and particularly between about 2% by weight to about 15% by weight. Other suitable foaming aids are described in U.S. Pat. No. 4,581,254 to Cunningham, et al., which is incorporated herein in its entirety by reference thereto.

Other examples of suitable materials that can be added to a liquid-based composition for application to various tissue products are disclosed in U.S. Pat. No. 5,869,075 to Krzvsik, which is incorporated herein by reference. For instance, some of such materials include, but are not limited to: anti-microbial agents; odor absorbers; masking fragrances; anti-septic actives; anti-oxidants; astringents—cosmetic (induce a tightening or tingling sensation on skin); astringent—drug (a drug product which checks oozing, discharge, or bleeding when applied to skin or mucous membrane and works by coagulating protein); biological additives (enhance the performance or consumer appeal of the product); colorants (impart color to the product); emollients (help to maintain the soft, smooth, and pliable appearance of the skin by their ability to remain on the skin surface or in the stratum corneum to act as lubricants, to reduce flaking, and to improve the skin's appearance); external analgesics (a topically applied drug that has a topical analgesic, anesthetic, or antipruritic effect by depressing cutaneous sensory receptors, of that has a topical counter-irritant effect by stimulating cutaneous sensory receptors); film formers (to hold active ingredients on the skin by producing a continuous film on skin upon drying); humectants (increase the water content of the top layers of the skin); natural moisturizing agents (NMF) and other skin moisturizing ingredients known in the art; opacifiers (reduce the clarity or transparent appearance of the product); skin conditioning agents; skin exfoliating agents (ingredients that increase the rate of skin cell turnover such as alpha hydroxy acids and beta hydroxyacids); skin protectants (a drug product which protects injured or exposed skin or mucous membrane surface from harmful or annoying stimuli); and the like.

Although various embodiments of the invention have been described using specific terms, devices, and methods, such description is for illustrative purposes only. The words used are words of description rather than of limitation. It is to be understood that changes and variations may be made by those of ordinary skill in the art without departing from the spirit or scope of the present invention, which is set forth in the following claims. In addition, it should be understood that aspects of the various embodiments may be interchanged both in whole or in part. Therefore, the spirit and scope of the appended claims should not be limited to the description of the preferred versions contained therein.

What is claimed is:

1. A method of foaming a softening composition onto a tissue, said method comprising the steps of:

forming a generally stable foam composition from a stream of a liquid-based softening composition and a stream of gas, wherein the blow ratio of said foam composition is greater than about 3:1;

providing a substantially dry tissue web having a first surface and a second surface, said first surface having elevated regions and non-elevated regions, said tissue web having a basis weight less than about 120 grams per square meter; and applying said foam composition to said first surface of said tissue web so that a greater amount of said softening composition resides on said elevated regions than on said non-elevated regions.

2. A method as defined in claim 1, further comprising the step of applying said foam composition to said second surface of said tissue web.

3. A method as defined in claim 1, wherein said blow ratio is between about 5:1 to about 180:1.

4. A method as defined in claim 1, wherein said blow ratio is between about 150:1 to about 180:1.

5. A method as defined in claim 1, wherein said blow ratio is between about 15:1 to about 25:1.

6. A method as defined in claim 1, wherein the half-life of said foam composition is greater than about 3 minutes.

7. A method as defined in claim 1, wherein the half-life of said foam composition is between about 3 minutes to about 30 minutes.

8. A method as defined in claim 1, wherein the half-life of said foam composition is between about 15 minutes to about 25 minutes.

9. A method as defined in claim 1, wherein said softening composition is hydrophilic.

10. A method as defined in claim 1, wherein said foam composition further comprises a foaming aid.

11. A method as defined in claim 1, further comprising the step of moving said tissue web in a certain direction at a speed greater than about 300 feet per minute, wherein said foam composition is applied to said tissue web as it moves in said certain direction.

12. A method as defined in claim 1, further comprising the step of controlling the flow rate of said stream of said liquid-based softening composition.

13. A method as defined in claim 1, further comprising the step of controlling the flow rate of said stream of gas.

14. A method of foaming a composition onto a tissue, said method comprising the steps of:

forming a generally stable foam composition from a stream of a softening composition and a stream of air, wherein the blow ratio of said foam composition is between about 5:1 to about 180:1;

providing a substantially dry tissue web having a first surface and a second surface, said tissue web having a basis weight less than about 120 grams per square meter, said first surface having elevated regions and non-elevated regions; and applying said foam composition to said elevated regions of said first surface of said tissue web such that a greater amount of said softening composition resides on said elevated regions of said first surface than on said non-elevated regions.

15. A method as defined in claim 14, further comprising the step of applying said foam composition to said second surface of said tissue web.

16. A method as defined in claim 14, wherein said blow ratio is between about 150:1 to about 180:1.

17. A method as defined in claim 14, wherein said blow ratio is between about 15:1 to about 25:1.

18. A method as defined in claim 14, wherein said softening composition further comprises a foaming aid.

19. A method as defined in claim 14, wherein said softening composition is hydrophilic.

20. A method of foaming a composition onto a tissue, said method comprising the steps of:

forming a generally stable foam composition from a stream of a hydrophilic softening composition and a stream of air, wherein the blow ratio of said foam composition is between about 5:1 to about 180:1;

providing a substantially dry uncreped, through-dried tissue web having a first surface and a second surface, said uncreped, through-dried tissue web having a basis weight less than about 120 grams per square meter, said first surface having elevated regions and non-elevated regions; and applying said foam composition to said elevated regions of said first surface of said uncreped, through-dried tissue web such that a greater amount of said softening composition resides on said elevated regions of said first surface than on said non-elevated regions.

* * * * *